US006508881B1

(12) United States Patent
Müller et al.

(10) Patent No.: US 6,508,881 B1
(45) Date of Patent: Jan. 21, 2003

(54) DEVICE FOR MAINTAINING CONSTANT A CERTAIN VISCOSITY OF AN ADHESIVE FOR PASTING THE SPINE OF AN INNER BOOK OR A BOOK COVER

(75) Inventors: Hans Müller, Lauda-Königshofen (DE); Karl Zweig, Boxberg-Wölchingen (DE)

(73) Assignee: Grapha-Holding AG, Hergiswil (CH)

( * ) Notice: Subject to any disclaimer, the term of this patent is extended or adjusted under 35 U.S.C. 154(b) by 0 days.

(21) Appl. No.: 09/651,430

(22) Filed: Aug. 30, 2000

(30) Foreign Application Priority Data

Sep. 22, 1999 (EP) ..... 99810849

(51) Int. Cl.[7] ..... B05C 1/02

(52) U.S. Cl. ..... 118/663; 118/665; 118/688; 118/249; 118/261; 412/37

(58) Field of Search ..... 118/663–665, 688, 118/249, 261; 412/37

(56) References Cited

U.S. PATENT DOCUMENTS 5,250,318 A * 10/1993 Tooker ..... 427/8
5,443,639 A * 8/1995 Hawkes ..... 118/244
5,693,142 A * 12/1997 Pedigrew et al. ..... 118/261

FOREIGN PATENT DOCUMENTS

| | | |
|---|---|---|
| DE | 4332069 | 3/1995 |
| EP | 0347752 | 12/1989 |

* cited by examiner

*Primary Examiner*—Laura Edwards
(74) *Attorney, Agent, or Firm*—Friedrich Kueffner

(57) ABSTRACT

A device for maintaining constant a certain viscosity of an adhesive, that is used for pasting a spine of an inner book or a book cover, by adding a diluent has an adhesive container filled with an adhesive. A rotating conveyor roll is immersed in the adhesive. An applicator roll is positioned downstream of the conveyor roll. It receives the adhesive from the conveyor roll and applies the adhesive onto a spine of an inner book or a book cover passing by the applicator roll. A stirring apparatus is arranged on the container and has a stirrer immersed in the adhesive. The stirring apparatus stirs the adhesive received in the container and also measures the viscosity of the adhesive received in the container. A control unit with a computer is connected to the stirring apparatus. The control unit compares a measured value of the viscosity with a set-point value of the viscosity and meters the diluent to the adhesive in order to regulate the viscosity.

8 Claims, 1 Drawing Sheet

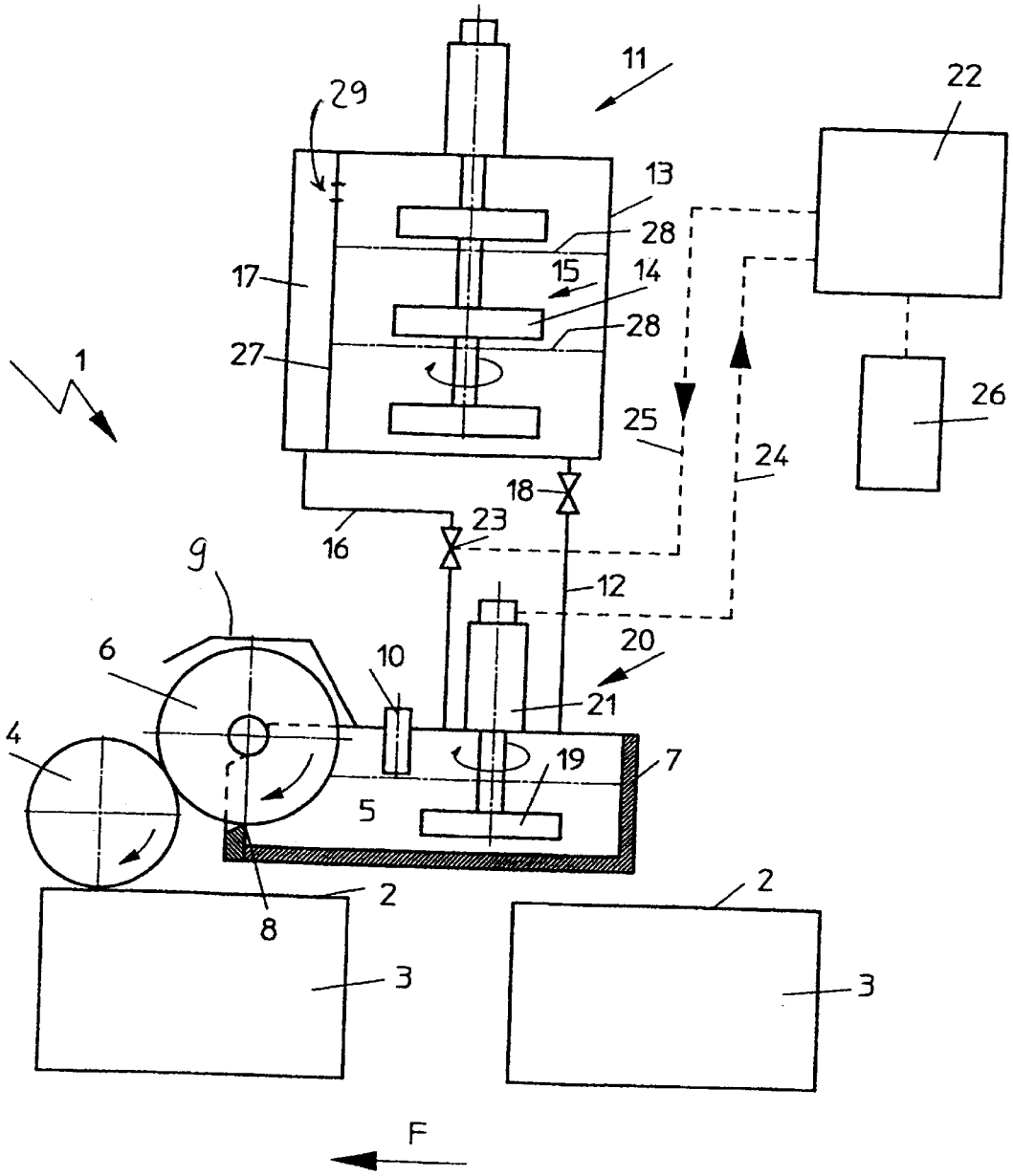
11
22
29
13
28
15
14
17
28
27
1
26
25
24
18
23
16
9
12
6
10
20
21
4
19
7
5
2
2
8
3
3
F

DEVICE FOR MAINTAINING CONSTANT A CERTAIN VISCOSITY OF AN ADHESIVE FOR PASTING THE SPINE OF AN INNER BOOK OR A BOOK COVER

BACKGROUND OF THE INVENTION

1. Field of the Invention

The invention relates to a device for maintaining constant a certain viscosity of an adhesive, that is used for pasting the spine of an inner book or a book cover, by adding a diluent. The device comprises a rotating conveyor roll immersed in an adhesive container containing an adhesive and an applicator roll arranged downstream thereof which applies the adhesive onto the spine or the book cover of inner books passing by on a transport line. The device further comprises means for stirring and measuring the viscosity of the adhesive in the adhesive container as well as a control unit for comparing a measured value with a set-point value of the viscosity. The control unit with computing function is connected to the means for measuring the viscosity for the purpose of metering the diluent to be added to the adhesive.

2. Description of the Related Art

A device of this kind is commercially available from Kolbus GmbH+Co. KG in connection with a book finishing production line. Since a substantially homogenous state of the adhesive should be present for the measurement of the viscosity of the adhesive, a viscometer as well as a stirring apparatus are required. However, especially the use of a viscometer as a measured value transducer with its own control device results in relatively high costs for the aforementioned device, the price tag being at the moment approximately 15,000 German marks.

SUMMARY OF THE INVENTION

It is an object of the present invention to provide a device of the aforementioned kind which results in a reduced cost expenditure in comparison to known devices while providing reliable functionality and simplicity.

In accordance with the present invention, this is achieved in that the stirrer is embodied as a stirring apparatus configured to measure the viscosity of the adhesive contained in the container.

Preferably, the metering of the diluent can be carried out based on the changes of the electrical current consumption of the motor of the stirring apparatus with constant rpm (revolutions per minute).

As an alternative, the metering of the diluent can be carried out based on the change of the rpm of the stirrer with constant electrical current supply to the motor of the stirring apparatus.

When metering the diluent based on the change of the electrical current consumption, it is advantageous to provide a current measuring device in the current supply line of the motor and to connect the current measuring device to the control unit.

In the alternative metering of the diluent based on the change of the rpm of the stirrer with constant electrical current supply of the motor, it is expedient to provide a revolution counter (tachometer) coupled to the stirrer shaft.

The important features in this connection are the double function of the stirring apparatus and the use of an already present stored program control SPC of the device, and these features result in a considerable reduction of the cost of acquisition of such a device.

BRIEF DESCRIPTION OF THE DRAWING

The only Figure of the drawing shows a schematic representation of the device according to the invention.

DESCRIPTION OF THE PREFERRED EMBODIMENTS

The only Figure shows schematically a device 1 for maintaining constant a certain viscosity of an adhesive 5 for pasting the spine 2 of an inner book 3 transported on a transport line. The arrow F indicates the transport direction of the inner books 3 which are clamped into a circulating conveying device (not shown). The upwardly oriented spine 2 of the inner book 3 is supplied with adhesive 5 by means of an applicator roll 4 rotating in the clockwise direction in the same direction as the conveyor roll 6. The adhesive 5 has been removed from the adhesive container 7 via a so-called adhesive gap 8 by means of the conveyor roll 6 arranged upstream of the applicator roll 4. The conveyor roll 6, rotating in the clockwise direction, is immersed with its lower portion in the adhesive 5 contained in the adhesive container 7 and conveys the adhesive 5 to the periphery of the applicator roll 4 which is preferably comprised of rubber. It is well known that this adhesive pasting technique is employed by different manufacturers of book insetting machines. A protective hood 9 is arranged above the conveyor roll 6, and the adhesive container 7 comprises a level monitoring device, indicated by reference numeral 10, for the purpose of controlling the filling level. In the represented embodiment, the adhesive 5 is supplied from a melting apparatus 11 via an adhesive supply line 12 to the adhesive container 7.

The supply of adhesive into the adhesive container 7 can be interrupted by a shut-off member 18 provided in the adhesive supply line 12.

The adhesive which is delivered as a soft (rubber-like) substance or mass, also referred to as hot-setting adhesive, is initially liquefied in the melting apparatus 11 and in its ready-to-use state has a temperature of 60 to 70° C. For this purpose, a melting container 13 is provided whose walls have an integrated heating device (not shown). For preventing evaporation of the liquid contained in the adhesive during the melting process in the melting container 13, the container 13 is closed off by a lid. A stirring device 15 comprised of three stirring elements 14 ensures a homogenous adhesive substance.

Due to the relatively high temperature of the adhesive substance and the stirring action, the evaporation of liquid in the adhesive is enhanced so that without a supply of liquid, such as, for example, water, an increasing thickening of the adhesive mass would result up to the soft state. For maintaining the liquid state of aggregation, a diluent is introduced into the adhesive 5 contained in the adhesive container 7 via a diluent supply line 15, either periodically or continuously. The diluent can be removed from a separate container 17, which is connected with the melting container 13 so that the diluent is heated in the interest of a favorable mixing process. The evaporation resulting from heating the water or the diluent could be transferred via a through opening 29, provided in the partition 27 between the container 17 and the melting container 13, into the melting container 13 and could be condensed therein. Of course, when using water as a diluent, water can be supplied directly from a water line or a mixed water line instead of from a container 17.

The stirrer 19 arranged in the adhesive container 7 is embodied as a stirring apparatus 20 which serves simultaneously for measuring the viscosity of the adhesive 5 contained in the adhesive container 7. The stirring apparatus 20 is comprised furthermore of an electric motor 21 which is supplied via a control unit 22 with energy, i.e., electrical current. The control unit 22 comprises a computer in which a certain set-point value of the viscosity for maintaining a constant viscosity level is saved, and the set-point value can be compared by means of the computer with a measured value of the viscosity state in the adhesive container 7; When a change of the measured value past a predetermined amount over the set-point value occurs as a result of increasing viscosity due to thickening of the adhesive 5 in the adhesive container 7, the computer triggers a signal which is sent to the control unit which causes a valve 23 arranged in the diluent supply line 16 to open for a certain amount of time so that diluent can flow or drip into the adhesive container 7. The triggered signal for metering the diluent can be initialized in two ways, in that it is generated based on a change of the electrical current consumption of the motor 21 of the stirring apparatus 20 for a constant rpm, ensured by a built-in motor speed sensor, or, alternatively, based on a rpm change of the stirrer 19 for constant electrical current supply to the motor 21 of the stirring apparatus 20.

In order to simplify the drawing, for both possibilities only one measured value line 24 is shown in the drawing extending from the stirring apparatus 20, embodied as a measured value sensor/transducer, to the control unit, respectively, to the computer.

The actuation of the valve 23 by the control unit 22 or the control is realized via a control line 25. By means of an input unit 26 the set-point value and the differential value between the measured value and the set-point value at which the valve 23 opens can be input or changed.

The device according to the invention could also be used in connection with the melting apparatus 11 provided with a three-stage stirring device 15 for determining the amount of adhesive within the melting container 13 wherein, based on a change of the current supply or the rpm of the stirrer shaft, the level of the adhesive could be determined. This application variant could be refined in that each stirrer element 14 is correlated with a certain level of the adhesive, as is indicated by the dash-dotted lines 28.

While specific embodiments of the invention have been shown and described in detail to illustrate the inventive principles, it will be understood that the invention may be embodied otherwise without departing from such principles.

What is claimed is:

1. A device for maintaining constant a certain viscosity of an adhesive, used for pasting a spine of an inner book or a book cover, by adding a diluent, the device comprising:

an adhesive container configured to receive an adhesive;

a rotating conveyor roll configured to be immersed in the adhesive;

an applicator roll positioned downstream of the conveyor roll and configured to receive the adhesive from the conveyor roll and to apply the adhesive onto a spine of an inner book or a book cover passing by the applicator roll;

a stirring apparatus arranged on the container and having a stirrer immersed in the adhesive;

the stirring apparatus configured to stir the adhesive received in the container and to measure the viscosity of the adhesive received in the container;

a control unit comprising a computer connected to the stirring apparatus;

a means for supplying the diluent connected to the adhesive container;

the control unit configured to compare a measured value of the viscosity with a set-point value of the viscosity;

the control unit further configured to meter the diluent to the adhesive in order to regulate the viscosity.

2. The device according to claim 1, wherein the control unit is configured to determine an amount of the diluent to be metered based on a change of electrical current consumption of the stirring apparatus, indicating a change in viscosity, with a constant rpm of the stirrer.

3. The device according to claim 2, further comprising a current measuring device arranged in a current supply line configured to supply the stirring apparatus with current, wherein the current measuring device is connected to the control unit.

4. The device according to claim 1, wherein the control unit is configured to determine an amount of the diluent to be metered based on a change of rpm of the stirrer, indicating a change in viscosity, with a constant current supply of the stirring apparatus.

5. The device according to claim 4, further comprising a revolution counter connected to a stirring shaft of the stirrer, wherein the control unit is connected to the revolution counter.

6. The device according to claim 1, further comprising a melting apparatus with a heatable melting container, wherein the means for supplying the diluent is a diluent container, wherein the heatable container and the diluent container adjoin one another and have a common partition, wherein the heatable container and the diluent container are arranged upstream of the adhesive container and are connected to the adhesive container to allow the adhesive and the diluent to flow into the adhesive container.

7. The device according to claim 6, wherein the diluent container is configured to be heated and wherein at least the common partition is configured to be heated in order to heat the diluent container.

8. The device according to claim 6, wherein the common partition has an upper end and wherein the upper end has a through opening connecting the diluent container and the melting container.

* * * * *